US007546833B2

(12) United States Patent
Tomomatsu et al.

(10) Patent No.: US 7,546,833 B2
(45) Date of Patent: Jun. 16, 2009

(54) FUEL FEED APPARATUS

(75) Inventors: Kenichi Tomomatsu, Kariya (JP); Tadashi Hazama, Chita-gun (JP); Eiji Iwanari, Chiryu (JP); Ryuji Igarashi, Nagoya (JP); Katsuhisa Yamada, Okazaki (JP)

(73) Assignee: DENSO CORPORATION, Kariya (JP)

( * ) Notice: Subject to any disclaimer, the term of this patent is extended or adjusted under 35 U.S.C. 154(b) by 101 days.

(21) Appl. No.: 11/653,372

(22) Filed: Jan. 16, 2007

(65) Prior Publication Data

US 2007/0199546 A1 Aug. 30, 2007

(30) Foreign Application Priority Data

Feb. 24, 2006 (JP) ..... 2006-049294
Jul. 10, 2006 (JP) ..... 2006-189745

(51) Int. Cl.
*F02M 37/04* (2006.01)

(52) U.S. Cl. ..... 123/509

(58) Field of Classification Search ..... 123/509, 123/514, 495

See application file for complete search history.

(56) References Cited

U.S. PATENT DOCUMENTS 5,263,459 A * 11/1993 Talaski ..... 123/516
5,596,970 A 1/1997 Schoenberg et al.
6,179,579 B1 1/2001 Dobler et al.
6,216,734 B1 4/2001 Umetsu et al.
6,425,377 B1 * 7/2002 Marx et al. ..... 123/509
6,425,734 B2 7/2002 Marx
6,672,288 B1 * 1/2004 Schelhas et al. ..... 123/509
6,854,451 B2 2/2005 Ebihara et al.
6,964,264 B2 * 11/2005 Yoshioka ..... 123/509
7,207,320 B2 * 4/2007 Ikeya ..... 123/509
2007/0215122 A1 * 9/2007 Nakagawa et al. ..... 123/509
2008/0138189 A1 * 6/2008 Hazama et al. ..... 417/423.1

* cited by examiner

*Primary Examiner*—Stephen K Cronin
*Assistant Examiner*—Arnold Castro
(74) *Attorney, Agent, or Firm*—Nixon & Vanderhye PC

(57) ABSTRACT

A fuel feed apparatus is accommodated in a fuel tank. The fuel feed apparatus includes a sub-tank that is provided in a bottom of the fuel tank. The fuel feed apparatus further includes a fuel pump that is accommodated in the sub-tank. The fuel pump includes an impeller that defines a plurality of pump chambers. The fuel pump has a first suction passage through which fuel flows from outside the sub-tank into at least one of the plurality of pump chambers. The fuel feed apparatus further includes an elastic member that seals between the first suction passage and the sub-tank.

16 Claims, 12 Drawing Sheets

FUEL FEED APPARATUS

CROSS REFERENCE TO RELATED APPLICATIONS

This application is based on and incorporates herein by reference Japanese Patent Applications No. 2006-49294 filed on Feb. 24, 2006 and No. 2006-189745 filed on Jul. 10, 2006.

FIELD OF THE INVENTION

The present invention relates to a fuel feed apparatus.

BACKGROUND OF THE INVENTION

According to U.S. Pat. No. 5,596,970, a fuel tank accommodates a fuel feed apparatus including a sub-tank. In this fuel feed apparatus, pump chambers are provided in two rows in a single impeller. Fuel is drawn through one of the pump chambers from outside the sub-tank. Fuel is drawn through the other of the pump chambers from inside the sub-tank. In this construction, a suction pipe of a fuel pump connecting with the sub-tank is formed of a hard material such as metal or hard resin. Accordingly, vibration of the fuel pump is apt to be transmitted to the sub-tank.

In U.S. Pat. No. 6,854,451 (JP-A-2004-190661), a support member, which is formed of resin, supports a fuel pump to absorb vibration. In this construction, it is conceivable to apply elastic resin to a suction pipe. However, when the suction pipe is formed of elastic resin, it is difficult to secure rigidity of the suction pipe.

A pump cover, which has the suction pipe, and the sub-tank may cause dimensional changes due to swelling in fuel, or the like. When the pump cover and the sub-tank are different in material from each other, dimensional changes caused in the suction pipe and the sub-tank are different from each other. In this case, It is difficult to secure airtightness at the connection between the suction pipe and the sub-tank because of the difference in dimensional changes.

SUMMARY OF THE INVENTION

In view of the foregoing and other problems, it is an object of the present invention to produce a fuel feed apparatus that is capable of restricting transmission of vibration and maintaining airtightness.

According to one aspect of the present invention, a fuel feed apparatus is accommodated in a fuel tank. The fuel feed apparatus includes a sub-tank that is provided in a bottom of the fuel tank. The fuel feed apparatus further includes a fuel pump that is accommodated in the sub-tank. The fuel pump includes an impeller that defines a plurality of pump chambers. The fuel pump has a first suction passage through which fuel flows from outside the sub-tank into at least one of the plurality of pump chambers. The fuel feed apparatus further includes an elastic member that seals between the first suction passage and the sub-tank.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
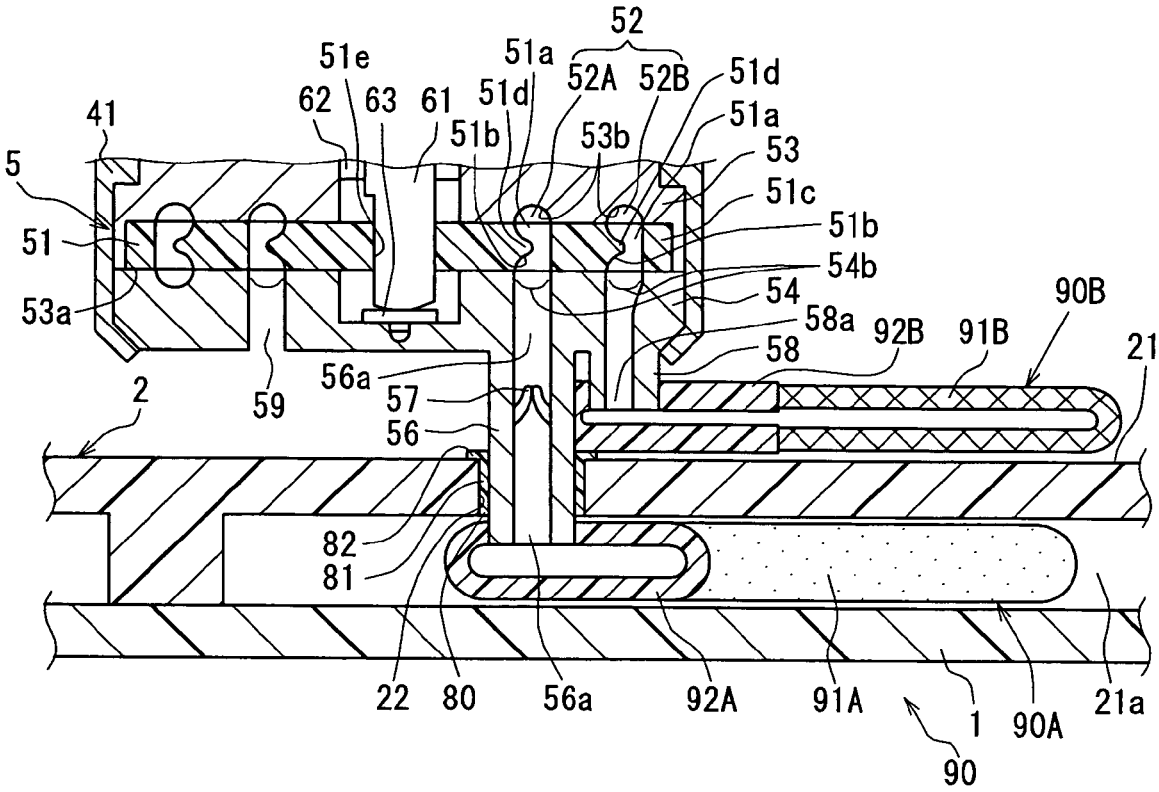
FIG. 1 is a partially sectional view showing a fuel feed apparatus having a sub-tank connecting with a suction passage of a fuel pump, according to a first embodiment.
Figure 2:
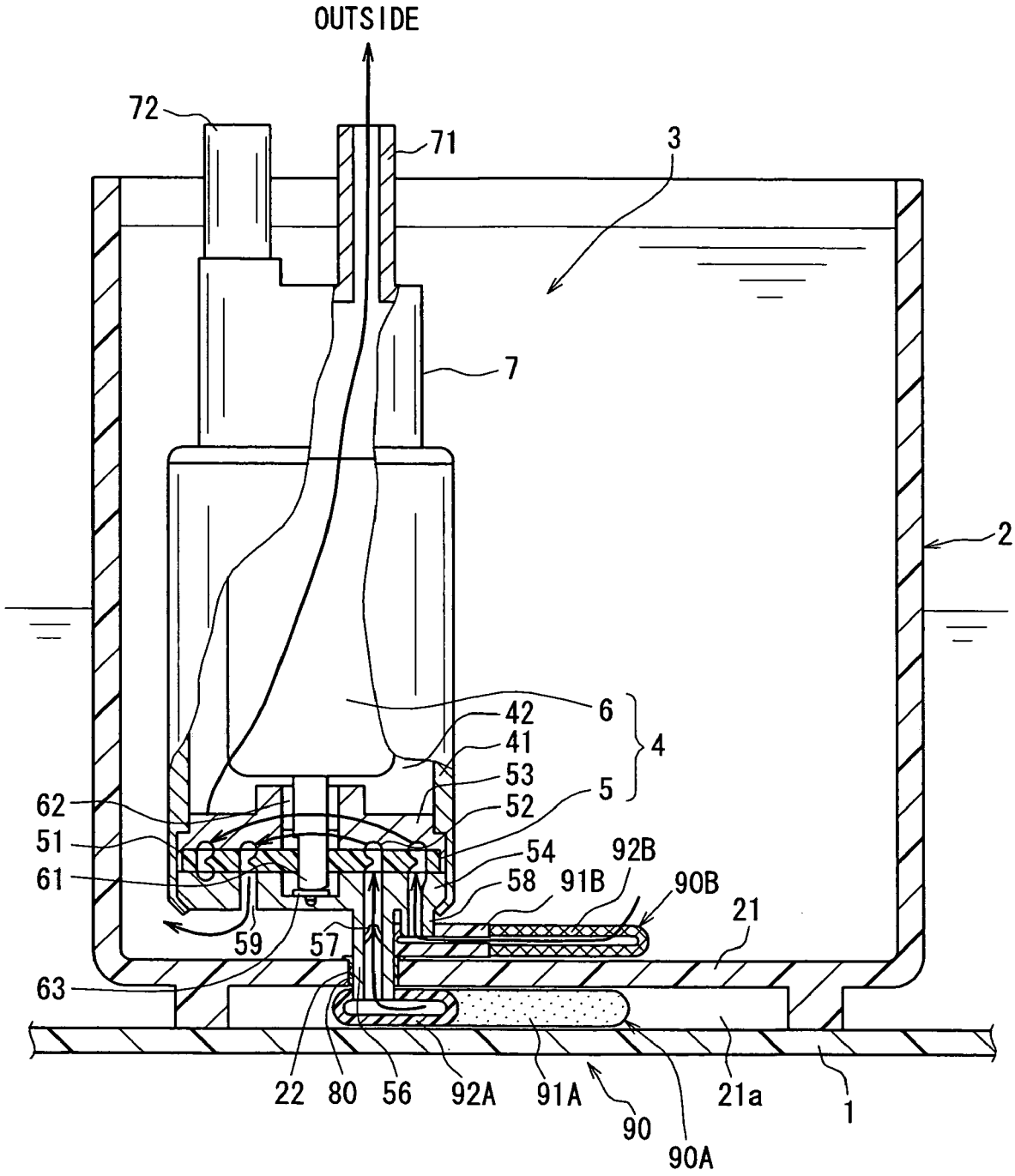
FIG. 2 is a partially sectional view showing a fuel feed apparatus accommodated in a fuel tank, according to the first embodiment.

As shown in FIGS. 1 and 2, a fuel feed apparatus is accommodated in a fuel tank 1. The fuel feed apparatus supplies fuel in the fuel tank 1 to a fuel consumption device, such as an engine, outside the fuel tank 1. The fuel feed apparatus includes a sub-tank 2 and a fuel pump 3. The sub-tank 2 is arranged in the bottom of the fuel tank 1. The fuel pump 3 is accommodated in the sub-tank 2.

The sub-tank 2 is formed of resin to be in a bottomed substantially cylindrical shape or in a substantially box shape. In this embodiment, the sub-tank 2 is in a substantially cylindrical shape. The sub-tank 2 accommodates therein fuel at a liquid level independently of a liquid level in the fuel tank 1.

A bottom portion 21 of the sub-tank 2 is arranged on the bottom of the fuel tank 1. The bottom portion 21 has a through-hole 22. The bottom portion 21 has a communicating portion 21*a* communicating with the bottom of the fuel tank 1. The communicating portion 21*a* has a space capable of accommodating therein a suction filter 90. The communicating portion 21*a* communicates with the interior of the fuel tank 1. A suction pipe 56 of the fuel pump 3 is inserted into the through-hole 22 to permit the fuel in the fuel tank 1 to be drawn into the sub-tank 2. The suction pipe 56 defines a suction passage 56*a* therein.

The fuel pump 3 includes a pump body 4 and an end cover 7. The pump body 4 includes a pump portion 5 and a motor portion 6. The end cover 7 is provided on a discharge side of the pump body 4.

The motor portion 6 is constructed of a DC motor having a brush, for example. The motor portion 6 has a substantially cylindrical housing 41. A permanent magnet (not shown) is arranged annularly in the housing 41. An armature (not shown) is arranged coaxially around the inner periphery of the permanent magnet. A bearing (not shown) is arranged centrally in the end cover 7 fixed to one end of the housing 41. Terminals, a brush, and a commutator, which are not shown, are embedded into a connector 72. The bearing rotatably supports radially one end of a shaft 61 of the armature. Electric power is supplied to a coil (not shown) of the armature through the terminals, the brush, and the commutator from an external electric source. The armature rotates, so that the shaft 61 rotates an impeller 51 of the pump portion 5. As the impeller 51 rotates, fuel is discharged into a fuel chamber 42 defined in the housing 41. The fuel is discharged outside the fuel tank 1 through a cylindrical portion 71 defined by the end cover 7.

The pump portion 5 includes the impeller 51, a casing 53, and a pump chamber cover 54. The casing 53 and the pump chamber cover 54 construct a casing. The casing rotatably accommodates therein the impeller 51.

As shown in FIGS. 1 and 2, the impeller 51 is in the form of a substantially annular plate. The impeller 51 is accommodated in a recess 53*a* of the casing 53. The impeller 51 is formed of resin, which is excellent in fuel resistance and high in strength. The surface of the impeller 51 on the side of the casing 53 defines a front surface. The surface of the impeller 51 on the side of the pump chamber cover 54 defines a back surface. Multiple vane pieces 51*a* are arranged along the entire circumference of the front and back surfaces of the impeller 51 in substantially the same phase. The vane pieces 51*a* are arranged corresponding to multiple pump chambers 52 defined in the casing 53 and the pump chamber cover 54. In this embodiment, the number of the pump chambers 52 is two.

Specifically, as referred to FIG. 2, first and second pump chambers 52A, 52B are arranged respectively on outer and inner peripheries of the impeller 51. The vane pieces 51*a* in two rows are arranged on the outer and inner peripheries of the impeller 51. The vane pieces 51*a* in two rows correspond to the second pump chamber 52B on the outer periphery and the first pump chamber 52A on the inner periphery.

Figure 3:
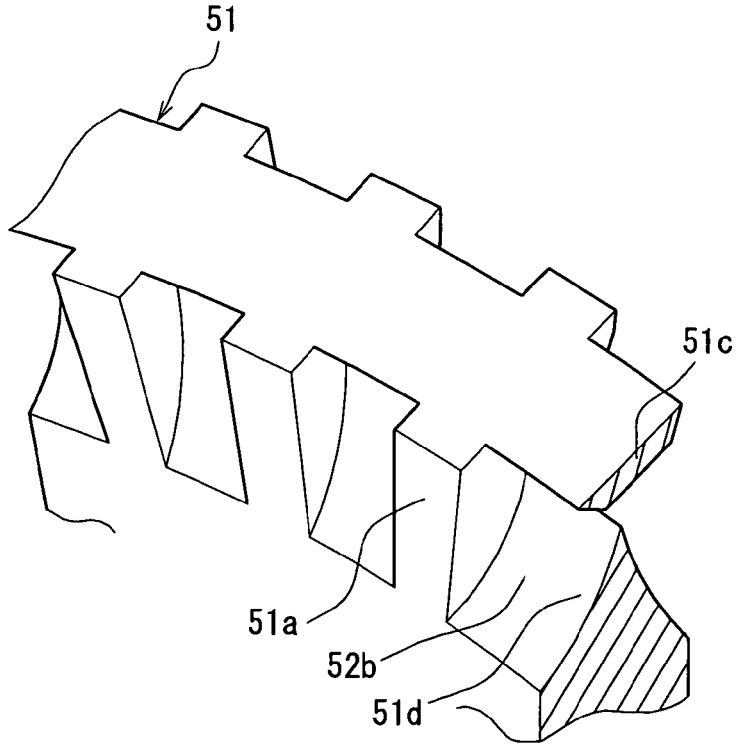
FIG. 3 is a perspective view showing an impeller of the fuel pump.

As shown in FIG. 3, vane grooves 51*b* are formed between mutually adjacent vane pieces 51*a*. The vane grooves 51*b* are formed on the entire circumference to correspond to the second pump chamber 52B. As shown in FIGS. 1 and 3, partitions 51*d* are provided in the vane grooves 51*b*. The partitions 51*d* radially outwardly project from the axial center of the vane grooves 51*b*. The partitions 51*d* divide the vane grooves 51*b* into halves on the front and back sides of the impeller 51. The partitions 51*d* substantially equally divide the vane grooves 51*b* with respect to the axial direction. Fuel is circulated in the vane grooves 51*b*, pump flow passages 53*b* of the casing 53, or pump flow passages 54*b* of the pump chamber cover 54, thereby being increased in pressure. The casing 53 defines the second pump chamber 52B.

The vane pieces 51*a*, the vane grooves 51*b*, and the partitions 51*d* are provided on the inner periphery of the impeller 51, which corresponds to the first pump chamber 52A, in the same manner as in the second pump chamber 52B.

As shown in FIGS. 1 and 3, the vane pieces 51*a* are formed integrally with an arcuate-shaped ring 51*c*. The arcuate-shaped ring 51*c* connects respective tip ends of mutually adjacent vane pieces 51*a* with each other. The outer periphery of the impeller 51 is closed integrally by the ring 51*c*. The impeller 51 has a through-hole 51*e*. The shaft 61 of the motor portion 6 is inserted into the through-hole 51*e*. The motor portion 6 drives the impeller 51 via the shaft 61 and the through-hole 51*e*.

The casing 53 and the pump chamber cover 54 are formed of materials, which are excellent in fuel resistance and high in strength, such as metal, aluminum die casting, or resin. The casing 53 has a substantially circular recess 53*a*. The recess 53*a* accommodates therein the impeller 51. An axial height of the recess 53*a* is greater by several μm to several tens of μm than the thickness of the impeller 51. The interiors of the casing 53 and of the pump chamber cover 54 and the impeller 51 define a predetermined axial clearance therebetween.

The bottom of the recess 53*a* defines the pump flow passages 53*b*. The pump flow passages 53*b* are substantially coaxial with the recess 53*a*. The pump flow passages 53*b* extend throughout a predetermined angular range. The fuel is increased in pressure within the pump flow passages 53*b* according to rotation of the impeller 51. The pump flow passage 54*b* is opposed to the recess 53*a* of the casing 53. The pump flow passages 53*b*, 54*b* define the pump chambers 52 with the impeller 51 therebetween.

As referred to FIG. 1, starting ends of the pump flow passages 53*b* communicate with a suction port 56*a* defined in the pump chamber cover 54. End portions of the pump flow passages 53*b* communicate with a discharge port 59 defined in the pump chamber cover 54. The starting ends of the pump flow passages 53*b* communicate with a suction port 58*a* defined in the pump chamber cover 54 within the second pump chamber 52B. The end portions of the pump flow passages 53*b* communicate with a discharge port (not shown) defined in the casing 53 and communicating with the fuel chamber 42.

A radial bearing 62 and a thrust bearing 63 are provided in the casing 53. The radial bearing 62 is provided to be coaxial with a bearing provided on the end cover 7 to cooperate therewith to radially support the shaft 61. The thrust bearing 63 restricts axial movement of the shaft 61.

The pump chamber cover 54 is a substantially circular plate. The pump chamber cover 54 is fixed at a predetermined position with respect to the casing 53. The pump chamber cover 54 has the suction port 56*a* and the suction port 58*a*. The suction port 56*a* and the suction port 58*a* extend from a surface faced to the pump flow passages 54*b*. The suction port 56*a* is defined in the suction pipe 56 formed integrally with the pump chamber cover 54. The suction port 58*a* is defined in a discharge pipe 58 formed integrally with the pump chamber cover 54.

A check valve 57 is provided in the suction pipe 56. The check valve 57 is positioned between the first pump chamber 52A and the suction port 56*a*. The check valve 57 restricts fuel from flowing in a reverse direction opposite to the suction direction through the suction pipe 56.

A suction filter 90 is provided to the suction port 56*a* and the suction port 58*a* of the respective first pump chambers 52A, 52B. The suction filter 90 includes a suction filter 90A and a discharge filter 90B. In the following descriptions, a structure of the suction filter 90A is described as the structure of the suction filter 90. An explanation of the discharge filter 90B is omitted. A subscript "A" of reference numerals represents that the corresponding component is used for charge of the sub-tank 2 and a subscript "B" represents that the corresponding component is used for discharge of the fuel tank 1.

The suction filter 90A filters fuel flowing inside from outside the sub-tank 2 to remove relatively large foreign matters contained in the fuel. The suction filter 90A has a filter body 91A and a mount member 92A. The mount member 92A is a fitting member for connecting the outer periphery of the suction filter 90A. The filter body 91A is formed of a material, such as nonwoven fabric, having a vibration absorbing property to be in the form of a bag. The filter body 91A is supported from inside by a skeleton member (not shown). The mount member 92A is formed of resin, or the like to permit the suction pipe 56 to extend through the mount member 92A. The mount member 92A is fitted airtightly to the outer periphery of the suction pipe 56.

Next, the connection between the sub-tank 2 and the suction pipe 56 is described. As referred to FIG. 2, the suction pipe 56 extends from the first pump chamber 52A toward the bottom of the fuel tank 1. The suction pipe 56 is inserted into the through-hole 22 of the bottom portion 21.

As referred to FIG. 1, an elastic member 80 is provided between the through-hole 22 and the suction pipe 56. The elastic member 80 seals the connection between the through-hole 22 and the suction pipe 56.

The elastic member 80 is capable of fitting two objects such as the through-hole 22 and the suction pipe 56 tightly therebetween. The elastic member 80 is formed of an elastic material, such as a rubber material, elastomer, resin, or the like.

The elastic member 80 has a substantially cylindrical portion 81. The cylindrical portion 81 is interposed between the inner periphery of the through-hole 22 and the outer periphery of the suction pipe 56. The elastic member 80 is interposed between the inner periphery of the through-hole 22 and the outer periphery of the suction pipe 56, so that the through-hole 22 can be tightly fitted to the suction pipe 56. The cylindrical portion 81 of the elastic member 80 seals radially between the inner periphery of the through-hole 22 and the outer periphery of the suction pipe 56.

The elastic member 80 has a first flange 82 extending radially from the cylindrical portion 81. When the elastic member 80 is assembled between the through-hole 22 and the suction pipe 56, the end surface of the first flange 82 faced to the bottom portion 21 is preferably fitted so as to abut against the bottom portion 21.

Next, the operation of the fuel feed apparatus is described. The engine is started, and an electric current is supplied to the fuel pump 3 through the connector. The armature of the motor portion 6 rotates, so that the impeller 51 rotates together with the shaft 61 of the armature. Fuel in the fuel tank 1 is drawn into the first pump chamber 52A through the suction filter 90A and the suction port 56*a*. The fuel receives kinetic energy from respective vanes of the impeller 51 upon rotation of the impeller 51, so that the fuel is discharged through the discharge port 59. The fuel discharged from the discharge port 59 is stored in the sub-tank 2.

Upon rotation of the impeller 51, the fuel is drawn from the sub-tank 2 into the second pump chamber 52B through the discharge filter 90B and the suction port 58*a*. The fuel receives kinetic energy from respective vanes of the impeller 51 to be discharged into the fuel chamber 42. The fuel discharged into the fuel chamber 42 passes around the armature to be discharged outside the fuel pump 3.

When the impeller 51 rotates, the fuel in the vane grooves 51*b* circulates in a space defined by the vane grooves 51*b* and the pump flow passages 53*b*, 54*b*. The fuel drawn into the second pump chamber 52B is applied with centrifugal force, which is generated by rotation of the impeller 51, thereby being directed to the outer peripheries of the vane grooves 51*b*, so that the fuel is changed in flow direction by the ring 51*c* to flow into the pump flow passages 53*b*. The fuel flows along the inner peripheries of the pump flow passages 53*b* along the rotative direction of the impeller 51, and enters the vane grooves 51*b* to be again directed to the outer peripheries of the vane grooves 51*b* along the partitions 51*d* by the centrifugal force. Repeating these movements together with the rotation of the impeller 51, the fuel is increased in pressure to be discharged from the discharge port communicating with the pump flow passages 53*b* into the fuel chamber 42. On the other hand, fuel flow symmetric to that in the pump flow passages 54*b* is generated in the pump flow passages 53*b*.

Repeating the above movements together with the rotation of the impeller 51, the fuel drawn from the suction port 56*a* is increased in pressure through the first pump chamber 52A together with the rotation of the impeller 51, in the same manner as in the second pump chamber 52B. Thus, the fuel is discharged from the discharge port 59, which communicates with the pump flow passages 54*b*, into the sub-tank 2.

The inner periphery of the suction pipe 56 defines a pump suction passage, through which fuel is drawn from the fuel tank 1. The cylindrical portion 81 of the elastic member 80 constructs a first elastic portion.

The fuel pump 3 has the first pump chamber 52A and the second pump chamber 52B in two rows with one impeller 51 therein. The suction port 56*a*, through which fuel in the fuel tank 1 is drawn into the sub-tank 2, extends to the first pump chamber 52A. The suction pipe 56 is provided to the fuel pump 3 to define the pump suction passage. The suction pipe 56 is inserted into the through-hole 22 of the bottom portion 21. A substantially cylindrical elastic member 80 is provided between the through-hole 22 and the suction pipe 56.

The elastic member 80 can be tightly fitted between the through-hole 22 and the suction pipe 56. The elastic member 80 is interposed between the through-hole 22 and the suction pipe 56, so that the bottom portion 21 and the suction pipe 56 do not contact directly with each other. The elastic member 80 restricts transmission of vibration to the sub-tank 2 due to vibration of the fuel pump 3 at the connection between the through-hole 22 and the suction pipe 56, in addition to enhancing airtightness with respect to the bottom portion 21.

The elastic member 80 has the cylindrical portion 81. The cylindrical portion 81 seals radially between the inner periphery of the through-hole 22 and the outer periphery of the suction pipe 56. The elastic member is interposed between the through-hole 22 and the suction pipe 56 in a relatively simple structure.

Preferably, the elastic member 80 includes the first flange 82, which extends radially from the cylindrical portion 81, in addition to the cylindrical portion 81. When the cylindrical portion 81 is assembled between the through-hole 22 and the suction pipe 56, the end surface of the first flange 82, which is opposed to the sub-tank 2, can be fitted so as to abut against the bottom portion 21. The elastic member 80 is assembled to the bottom portion 21, so that the elastic member 80 can be steadily located in the connection between the through-hole 22 and the suction pipe 56.

The check valve 57 is provided in the suction pipe 56 to restrict the fuel from flowing in the reverse direction. That is, the check valve 57 restricts the fuel drawn by the fuel pump 3 from causing backflow into the fuel tank 1. The fuel drawn by the fuel pump 3 can be accommodated in the sub-tank 2 and the suction pipe 56 even when the fuel pump 3 stops, so that fuel can be efficiently drawn from the fuel tank 1 into the sub-tank 2.

The first pump chamber 52A is arranged radially inside with respect to the second pump chamber 52B. The second pump chamber 52B is arranged on the side of the radially outer periphery of the impeller 51, and the first pump chamber 52A is arranged on the side of the radially inner periphery of the impeller 51. In this structure, fuel, which is pressurized in the second pump chamber 52B to be discharged outside the fuel tank 1, can be effectively increased in pressure by utilizing the circumferential speed of the impeller 51. Fuel, which need not be greatly pressurized, flows from the fuel tank 1 into the sub-tank 2 through the first pump chamber 52A. The second pump chamber 52B and the first pump chamber 52A can be arranged to properly utilize the circumferential speed of the impeller 51, so that fuel can be efficiently pressurized in accordance with the destination.

Second Embodiment

Figure 4:
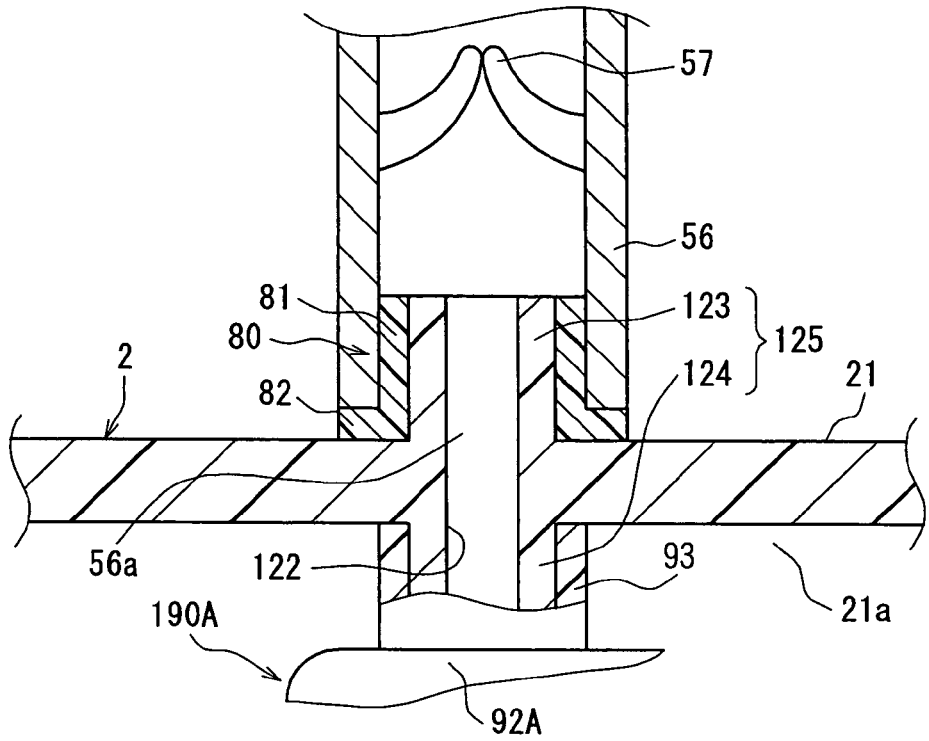
FIG. 4 is a partially sectional view showing a connection between a sub-tank and a suction passage of a fuel pump, according to a second embodiment.

As shown in FIG. 4, a first projection 123 is provided to the bottom portion 21 in this second embodiment. An elastic member 80 having a cylindrical portion 81 and a first flange 82 is arranged between the outer periphery of the first projection 123 and the inner periphery of a suction pipe 56. The first projection 123, which is provided to the bottom portion 21, is in a substantially cylindrical shape. The first projection 123 extends toward a fuel pump 3. A through-hole 122 is defined in the first projection 123. The height, by which the first projection 123 projects from the bottom portion 21, is greater than the thickness of the bottom portion 21 in this embodiment. The height of the first projection 123 may be equal to or less than the thickness of the bottom portion 21.

A second projection 124 is provided to the end surface of the bottom portion 21 opposite to the first projection 123. The second projection 124 is cylindrical to extend toward the fuel tank 1. The first projection 123 and the second projection 124 have the through-hole 122 therein to define a suction passage 125 in the bottom portion 21.

The outer periphery of the second projection 124 is fitted into a filter 190A. The filter 190A has a sleeve 93 on a mount member 92A. The sleeve 93 is fitted airtightly onto the outer periphery of the second projection 124. The position of the sleeve 93 is determined by the second projection 124, so that the filter 190A is aligned relative to the bottom portion 21.

The cylindrical portion 81 and the first flange 82 of the elastic member 80 are tightly fitted between the suction pipe 56 and the bottom portion 21. The cylindrical portion 81 is interposed radially between the inner periphery of the suction pipe 56 and the outer periphery of the first projection 123. The cylindrical portion 81 seals radially between the suction pipe 56 and the first projection 123 of the bottom portion 21.

The first flange 82 is interposed axially between the end surface of the suction pipe 56 on the side of the sub-tank 2 and the end surface of the bottom portion 21 on which the first projection 123 is formed. The first flange 82 seals axially between the suction pipe 56 and the bottom portion 21. This construction produces the same effect as in the first embodiment.

The elastic member 80 has the cylindrical portion 81 and the first flange 82. Vibration of the fuel pump 3 can be dispersedly absorbed by the cylindrical portion 81 and the first flange 82 of the elastic member 80, so that transmission of vibration to the sub-tank 2 can be effectively restricted. Radial vibration of the fuel pump 3 can be absorbed efficiently by the cylindrical portion 81, and axial vibration can be absorbed efficiently by the first flange 82.

The height, by which the first projection 123 projects from the bottom portion 21, is preferably greater than the thickness of the bottom portion 21, so that the length of sealing of the cylindrical portion 81 can be set to be large.

The sleeve 93 may be omitted.

Third Embodiment

Figure 5:
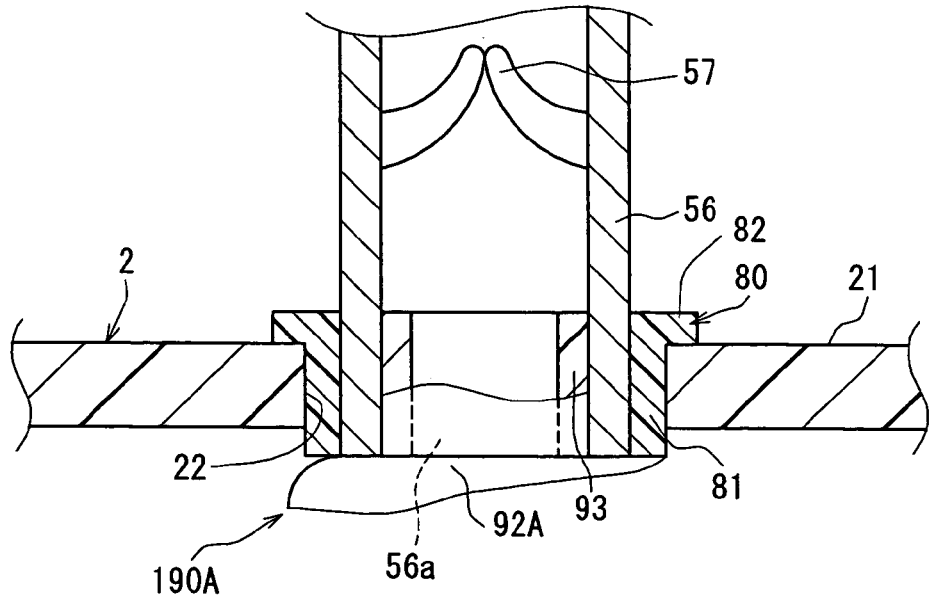
FIG. 5 is a partially sectional view showing a connection between a sub-tank and a suction passage of a fuel pump, according to a third embodiment.

As shown in FIG. 5, a filter 190A has a sleeve 93. The outer periphery of the sleeve 93 is fitted onto the inner periphery of a suction pipe 56, so that the filter 190A is mounted to the suction pipe 56.

The outer periphery of the sleeve 93 of the filter 190A is fitted into the inner periphery of the suction pipe 56.

The sleeve 93 projects from the upper end surface of a mount member 92A. The upper end surface of the mount member 92A abuts against the end surface of the suction pipe 56 on the side of the fuel tank 1 whereby the mount position of the filter 190A is fixed relative to the suction pipe 56. This construction also produces the same effect as in the first embodiment.

Fourth Embodiment

Figure 6:
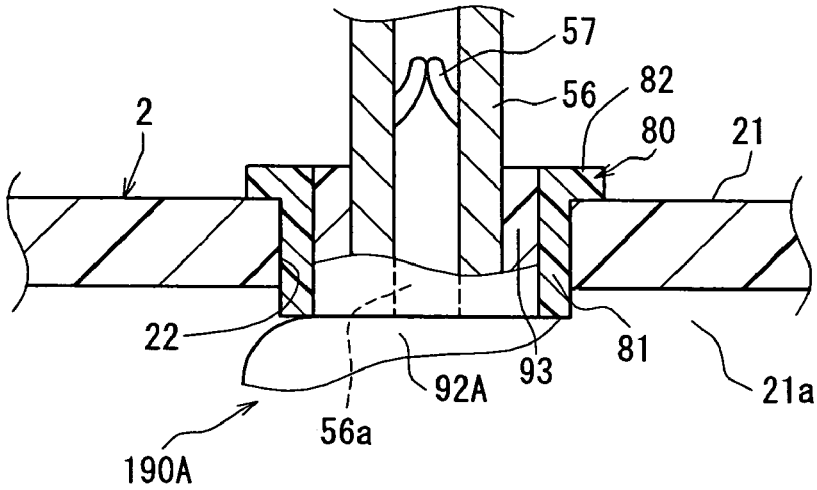
FIG. 6 is a partially sectional view showing a connection between a sub-tank and a suction passage of a fuel pump, according to a fourth embodiment.

As shown in FIG. 6, a sleeve 93 and an elastic member 80 are interposed between the through-hole 22 of the bottom portion 21 and the outer periphery of the suction pipe 56. The elastic member 80 is tightly fitted between the inner periphery of the through-hole 22 of the bottom portion 21 and the outer periphery of the sleeve 93 of a filter 190A. The inner periphery of the sleeve 93 and the outer periphery of the suction pipe 56 fit mutually thereby connecting with each other. Preferably, the same material is used for both the sleeve 93 and the suction pipe 56. This construction also produces the same effect as in the first embodiment.

Fifth Embodiment

Figure 7:
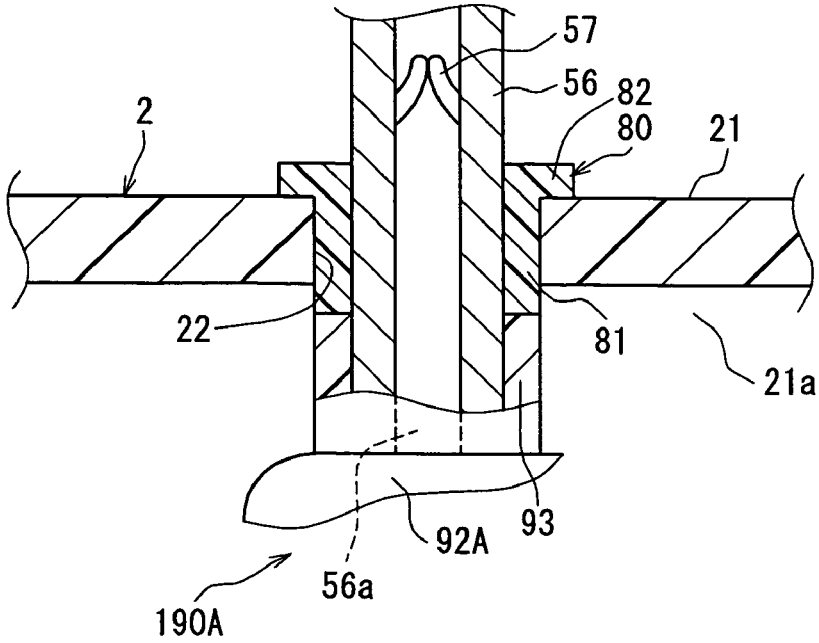
FIG. 7 is a partially sectional view showing a connection between a sub-tank and a suction passage of a fuel pump, according to a fifth embodiment.

As shown in FIG. 7, the suction pipe 56 extends, thereby being inserted into an elastic member 80. The inner periphery of a sleeve 93 is fitted onto the outer periphery of the suction pipe 56.

The elastic member 80 is tightly fitted between the inner periphery of the through-hole 22 and the outer periphery of the suction pipe 56. The suction pipe 56 extends downward in FIG. 7 from the connection between the suction pipe 56 and the bottom portion 21. The lower end of the suction pipe 56 extends from the connection between the suction pipe 56 and the bottom portion 21. The lower end of the suction pipe 56 has the outer periphery that is fitted into the inner periphery of the sleeve 93 of the filter 190A. This construction also produces the same effect as in the first embodiment.

The upper end surface of the sleeve 93 abuts against the end surface of the cylindrical portion 81 of the elastic member 80. The position of the filter 190A is fixed relative to the bottom portion 21 and the suction pipe 56.

Sixth Embodiment

Figure 8:
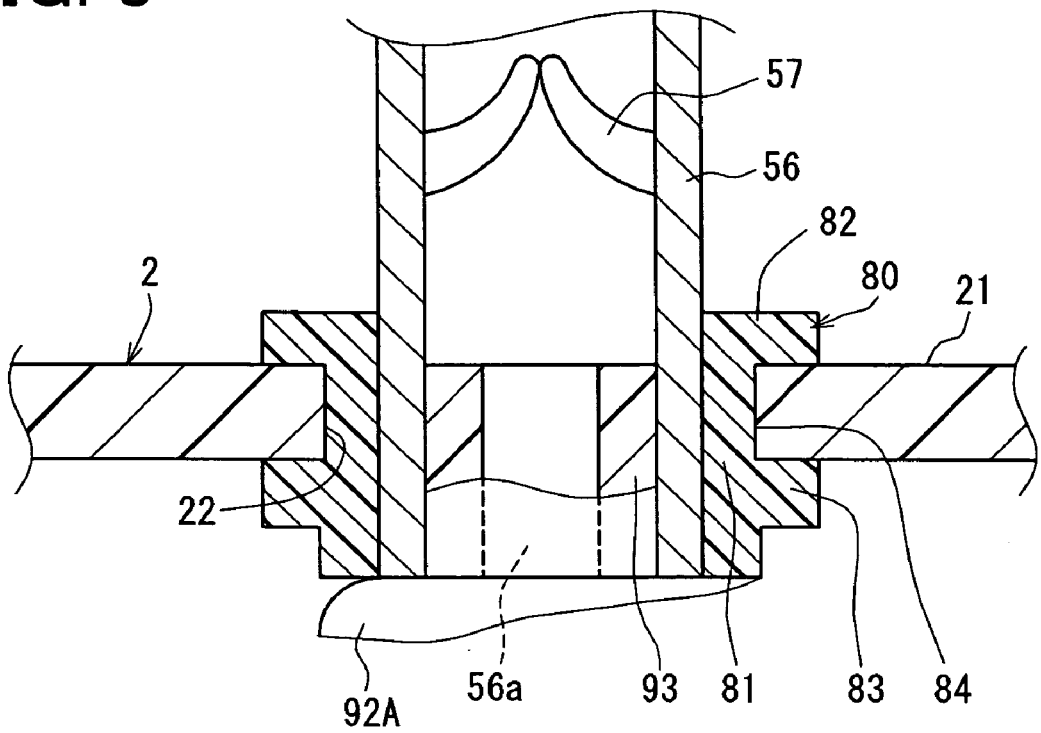
FIG. 8 is a partially sectional view showing a connection between a sub-tank and a suction passage of a fuel pump, according to a sixth embodiment.

As shown in FIG. 8, an elastic member 80 has a recess 84 conformed to the through-hole 22 of the sub-tank 2. The elastic member 80 includes a cylindrical portion 81, which defines the recess 84, a first flange 82, and a second flange 83. The first flange 82 and the second flange 83 of the elastic member 80 interpose and fit onto the front and back surfaces of the sub-tank 2. That is, the first flange 82 and the second flange 83 interpose the bottom surface inside the sub-tank 2 and the surface outside the sub-tank 2, thereby interposing both the front and back surfaces of the sub-tank 2.

In this embodiment, the second flange 83 is provided on the cylindrical portion 81 midway through the axial direction thereof. However, the position of the second flange 83 is not limited thereto, and may be provided at an axial end of the cylindrical portion 81, for example. The elastic member 80 may include an annular-shaped member having any cross section in such as a substantially rectangular shape shown in FIG. 6 as a whole, a substantially semi-circular shape, or a polygonal-shape.

In this embodiment, the recess 84 of the elastic member 80 is fitted into the through-hole of the sub-tank, thereby connecting with both the surfaces of the sub-tank and the inner periphery of the through-hole. The recess 84 serves as an interposing part, which interposes both surfaces of the sub-tank.

The elastic member 80 has at least the cylindrical portion 81 sealing the connection between the through-hole 22 of the sub-tank 2 and the suction pipe 56. Therefore, the elastic member 80 can restrict transmission of vibration to the sub-tank 2, and improve airtightness between the suction pipe 56 and the sub-tank 2, in the same manner as in the third embodiment.

The elastic member 80 includes a first flange 82, which abuts against the bottom portion 21 of the sub-tank 2 when fitted into the through-hole 22 of the sub-tank 2. Therefore, the elastic member 80 is steadily interposed at the connection between the through-hole 22 and the suction pipe 56.

The elastic member may be constructed of only the cylindrical portion 81 and the first flange 82, which is provided to one axial end of the cylindrical portion 81. However, in this structure, the elastic member 80 may be dislocated or detached from the through-hole 22 of the sub-tank 2 when excessive vibration is applied thereto from the fuel pump 3, the internal combustion engine, or the vehicle. In contrast, in this embodiment, the elastic member 80 defines the recess 84, via which the elastic member 80 is fitted to both the surfaces of the sub-tank 2 and the inner periphery of the through-hole 22. Thus, the recess 84 can be interposed between the peripheral edges of the through-hole 22 on both the surfaces of the sub-tank 2, so that the elastic member 80 can be restricted from causing dislocation or detachment relative to the sub-tank 2.

Seventh Embodiment

Figure 9:
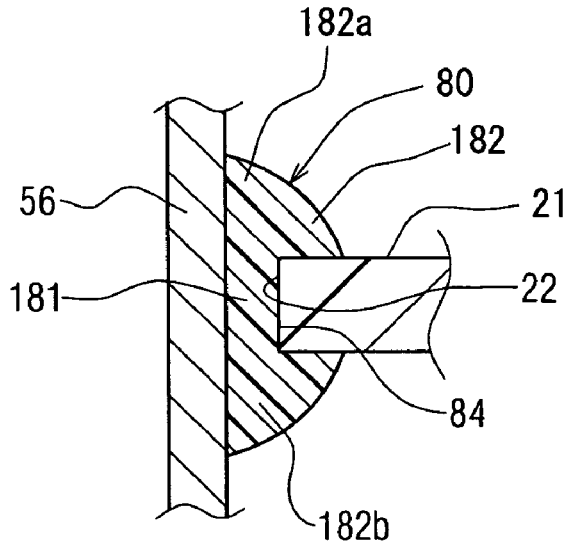
FIG. 9 is a partially sectional view showing a connection between a sub-tank and a suction passage of a fuel pump, according to a seventh embodiment.

As shown in FIG. 9, an elastic member 80 includes a semi-annular ring 182 having a substantially semi-circular section. The inner periphery of the semi-annular ring 182 is fitted onto the outer periphery of the suction pipe 56. The elastic member 80 has the outer periphery defining a recess 84 via which the elastic member 80 is fitted onto the through-hole 22 of the sub-tank 2. The semi-annular ring 182 includes a cylindrical portion 181 defining the recess 84. The cylindrical portion 181 radially connects with the outer periphery of the suction pipe 56. Substantially quarterly, semi-circular shaped flanges 182*a*, 182*b* extend respectively from both axial ends of the cylindrical portion 181. This construction also produces the same effect as in the sixth embodiment.

Eighth Embodiment

Figure 10:
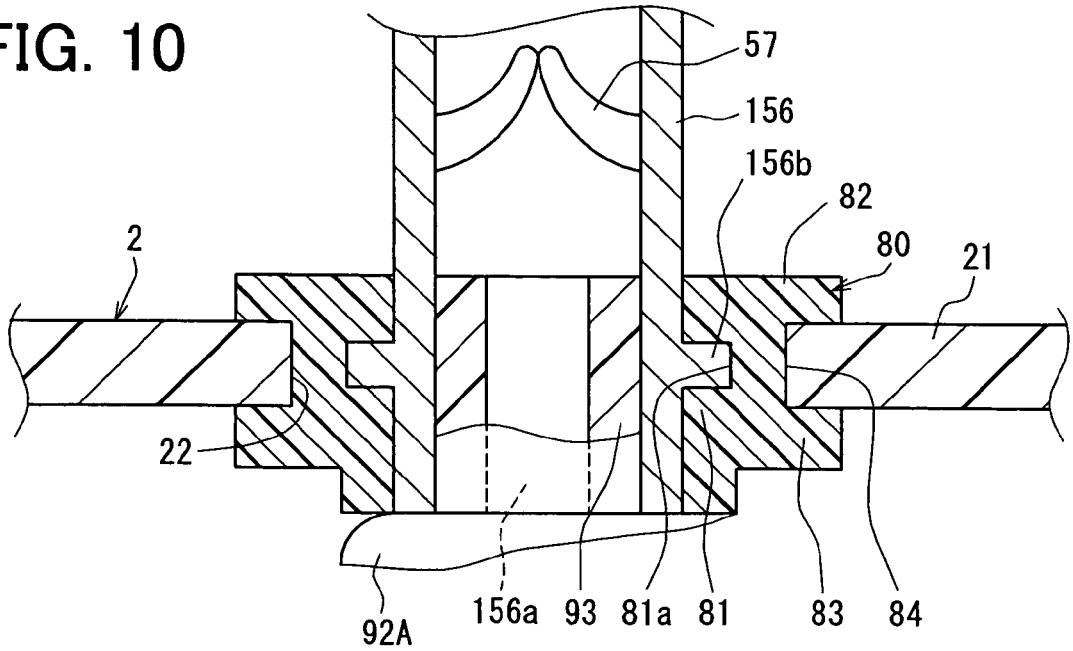
FIG. 10 is a partially sectional view showing a connection between a sub-tank and a suction passage of a fuel pump, according to an eighth embodiment.

As shown in FIG. 10, a latch portion 156*b* is provided to restrict dislocation of a suction pipe 156 and an elastic member 80. The suction pipe 156 includes a latch portion 156*b* projecting radially from the outer periphery thereof into the inner periphery of the elastic member 80. The inner periphery of the elastic member 80 has a recess 81*a* to correspond to the latch portion 156*b*. For example, when excessive vibration is applied to the suction pipe 156 and the sleeve 93, the suction pipe 156 and the sleeve 93 can be restricted from being dislocated relative to the elastic member 80.

Ninth Embodiment

Figure 11:
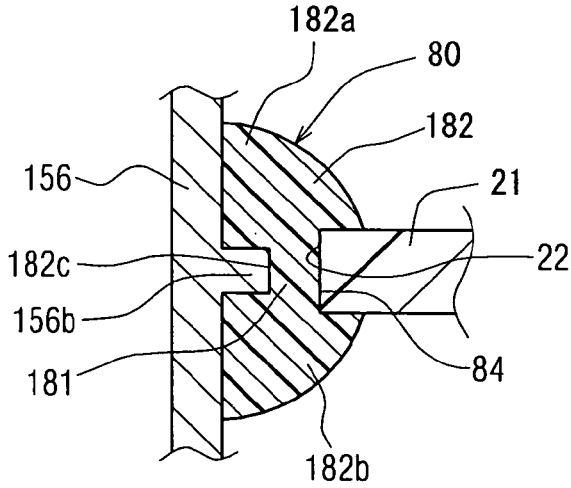
FIG. 11 is a partially sectional view showing a connection between a sub-tank and a suction passage of a fuel pump, according to a ninth embodiment.

As shown in FIG. 11, an elastic member 80 has a recess 84 and a recess 182*c*. The elastic member 80 has a substantially semi-circular cross section. The elastic member 80 serves as a semi-annular ring 182 being substantially semi-circular in cross section. The inner periphery of the semi-annular ring 182 is fitted onto the outer periphery of the suction pipe 156. The inner periphery of the semi-annular ring 182 has a recess 182*c* corresponding to the latch portion 156*b* of the suction pipe 156. This construction also produces the same effect as in the eighth embodiment.

Tenth Embodiment

Figure 12:
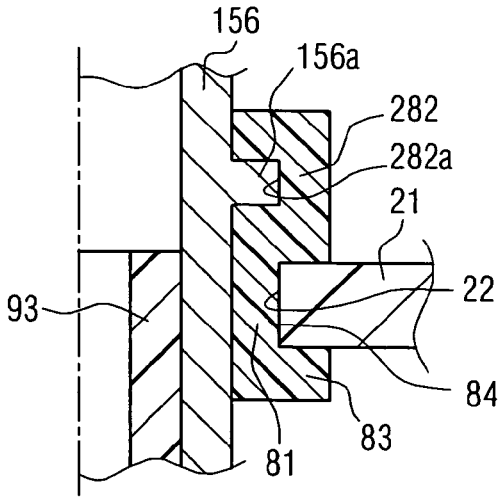
FIG. 12 is a partially sectional view showing a connection between a sub-tank and a suction passage of a fuel pump, according to a tenth embodiment.

As shown in FIG. 12, an elastic member 80 has a recess 84 and a recess 282*a*, which are axially spaced from each other. The recess 282*a* is defined in the inner periphery of the elastic member 80. The recess 282*a* is arranged axially upward in FIG. 12 relative to the recess 84.

This construction also produces the same effect as in the eighth embodiment. The recess 282*a* may be arranged downward in the axial direction in FIG. 12 relative to the recess 84.

Eleventh Embodiment

Figure 13:
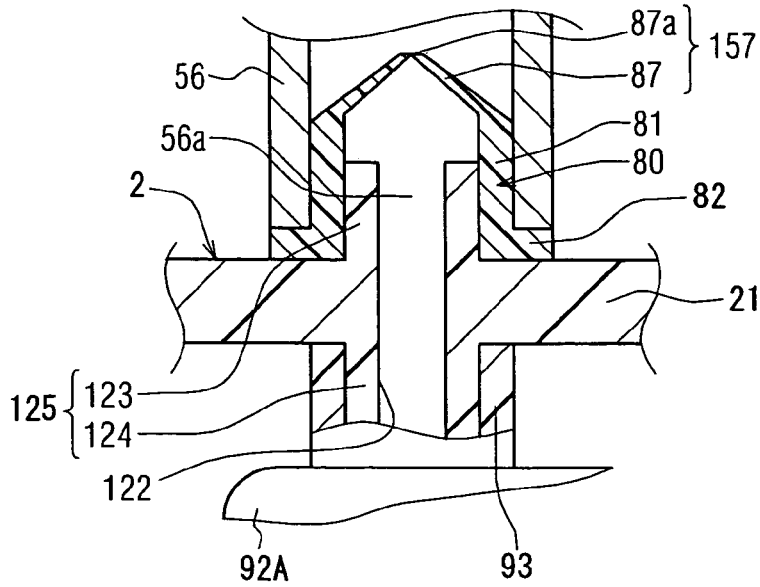
FIG. 13 is a partially sectional view showing a connection between a sub-tank and a suction passage of a fuel pump, according to an eleventh embodiment.

As shown in FIG. 13, a check valve 157 is formed integrally with an elastic member 80. The check valve 157 is a well-known duckbill valve. A duckbill valve has a cylindrical portion, which is tapered along the fuel flow direction. Alternatively, a duckbill valve has two abutments extending from the cylindrical portion. The check valve 157 is formed integrally with the upper end of an axially extending cylindrical portion 81 of the elastic member 80. A conical portion 87 is formed directly on the cylindrical portion 81 of the check valve 157. The cylindrical portion 81 corresponds to the above cylindrical portion. The conical portion 87 has an opening 87*a* at the tip end thereof.

The check valve 157 is formed integrally with the elastic member 80, so that the number of components can be reduced. The elastic member 80 is assembled, so that the check valve 157 is assembled in the suction pipe 56 at the same time, thus improving productivity. Therefore, productivity can be improved without increasing the components.

Twelfth Embodiment

Figure 14:
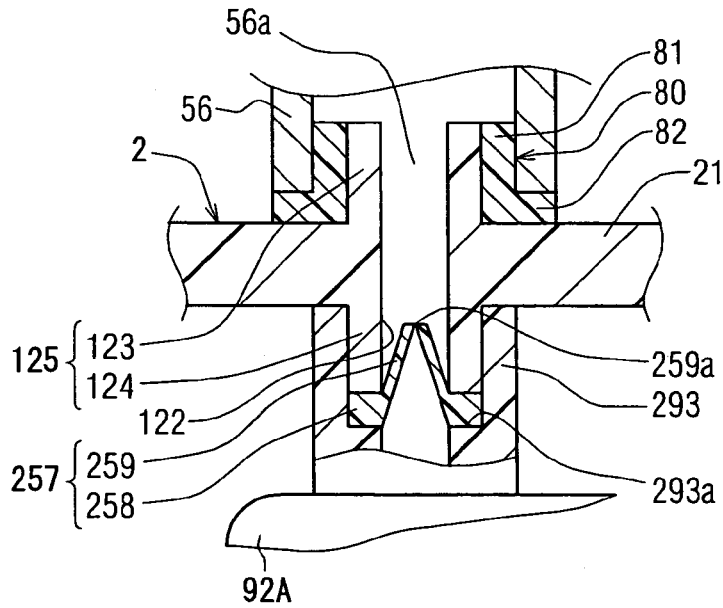
FIG. 14 is a partially sectional view showing a connection between a sub-tank and a suction passage of a fuel pump, according to a twelfth embodiment.

As shown in FIG. 14, a check valve 257 having a construction of a duckbill valve is arranged between the second projection 124 of the sub-tank 2 and a step 293*a* of a sleeve 293 of a suction filter. The check valve 257 includes a cylindrical portion 258 and a conical-shaped portion 259 provided to an upper end of the cylindrical portion 258. The check valve 257 has an opening 259*a* in the tip end of the conical-shaped portion 259. The cylindrical portion 258 also corresponds to the above cylindrical portion. The cylindrical portion 258 is interposed between the second projection 124 and the step 293*a* of the sleeve 293 to construct a sealing member, which is fitted onto the second projection 124 and the step 293*a*.

This construction also produces the same effect as in the eleventh embodiment.

Thirteenth Embodiment

Figure 15:
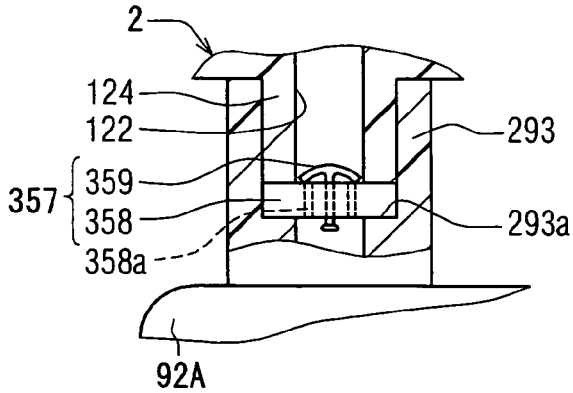
FIG. 15 is a partially sectional view showing a connection between a sub-tank and a suction passage of a fuel pump, according to a thirteenth embodiment.

As shown in FIG. 15, a check valve 357 has a construction of an umbrella valve. The check valve 357 includes a cylindrical portion 358 and an umbrella portion 359. The umbrella portion 359 is supported by a holding portion in the radially center of the cylindrical portion 358, thereby being axially movable. The cylindrical portion 358 has second suction passages 358*a*. The umbrella portion 359 communicates and brocks at least one of the second suction passages 358*a*. The cylindrical portion 358 is interposed between a second projection 124 and the step 293*a* of the sleeve 293 to be fitted therebetween. The umbrella portion 359 is constructed of an elastic member, which is readily deformable with respect to the flow direction of fuel.

This construction also produces the same effect as in the twelfth embodiment.

Fourteenth Embodiment

Figure 16:
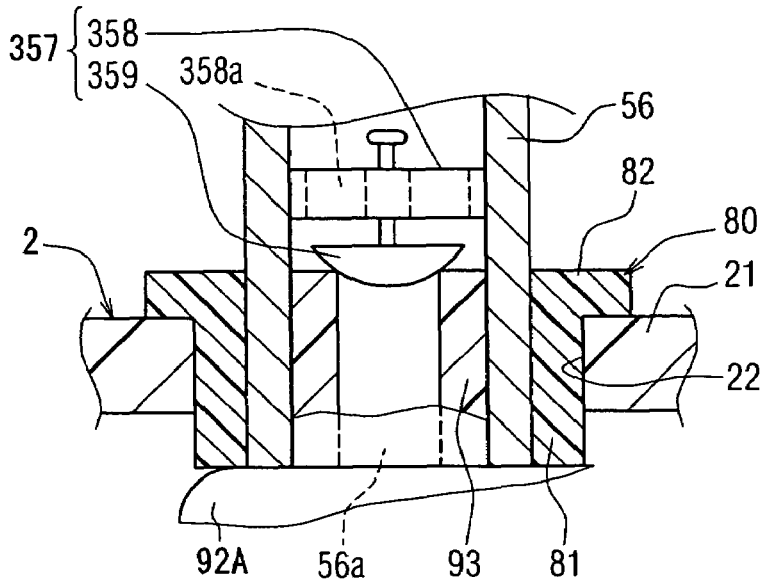
FIG. 16 is a partially sectional view showing a connection between a sub-tank and a suction passage of a fuel pump, according to a fourteenth embodiment.
Figure 17:
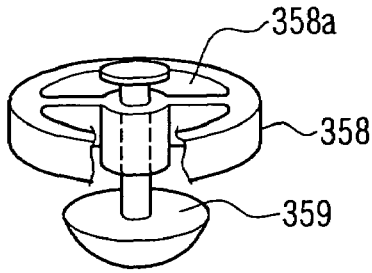
FIG. 17 is a perspective view showing a check valve depicted in FIG. 16.

As shown in FIGS. 16 and 17, a check valve 357 has a construction of a poppet valve. An umbrella portion 359 possesses such rigidity as not to be readily deformable with respect to the flow direction of fuel. The umbrella portion 359 can be seated on and lifted from the end of a sleeve 93. The end of the sleeve 93 serves also as a valve seat. The outer periphery of a cylindrical portion 358 is press fitted into the inner periphery of the suction pipe 56.

Fifteenth Embodiment

Figure 18:
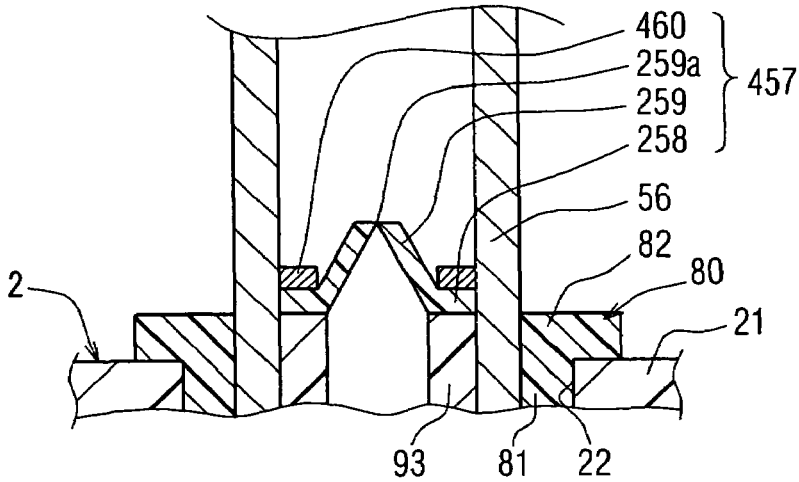
FIG. 18 is a partially sectional view showing a connection between a sub-tank and a suction passage of a fuel pump, according to a fifteenth embodiment.

As shown in FIG. 18, a check valve 457 has a construction of a duckbill valve. The check valve 457 includes duckbill valve bodies 258, 259 and an annular-shaped member 460. The duckbill valve bodies 258, 259 are interposed between the end of a sleeve 93 and the annular-shaped member 460 to be fitted therebetween.

Sixteenth Embodiment

Figure 19:
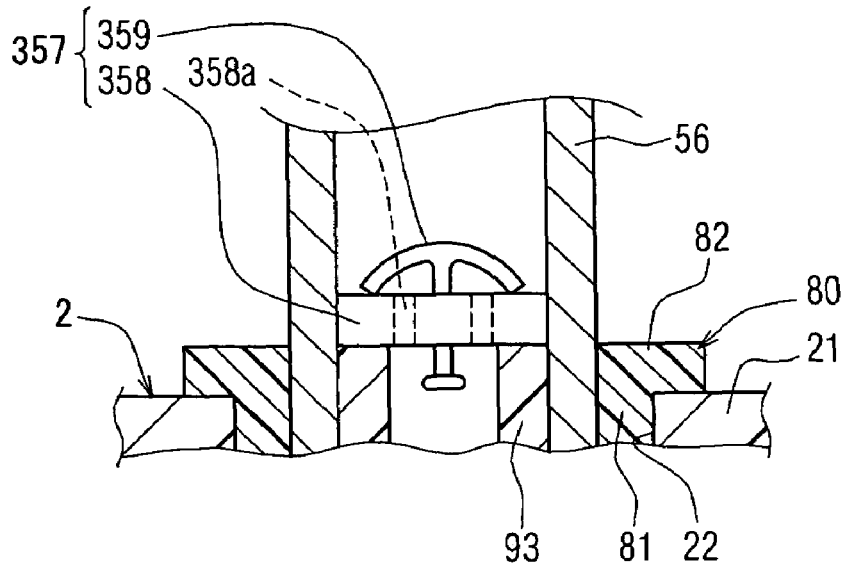
FIG. 19 is a partially sectional view showing a connection between a sub-tank and a suction passage of a fuel pump, according to a sixteenth embodiment.
Figure 20:
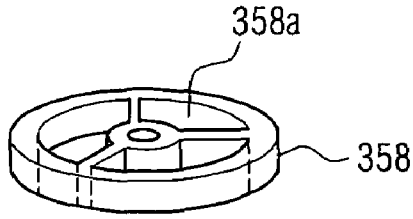
FIG. 20 is a perspective view showing a valve seat of a check valve depicted in FIG. 19.
Figure 21:
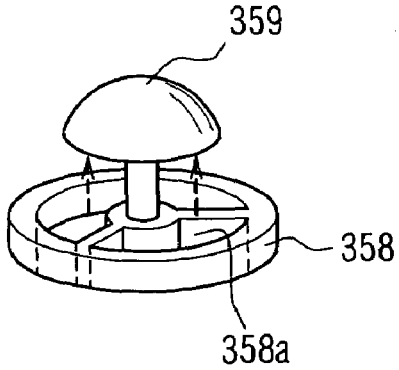
FIG. 21 is a perspective view showing the check valve, when communicating a passage therein, depicted in FIG. 19.

As shown in FIGS. 19, 20, and 21, the check valve 357 has a construction of an umbrella valve. The umbrella portion 359 is constructed of an elastic member, which is readily deformable. The outer periphery of the cylindrical portion 358 is press fitted into the inner periphery of the suction pipe 56.

Seventeenth Embodiment

Figure 22:
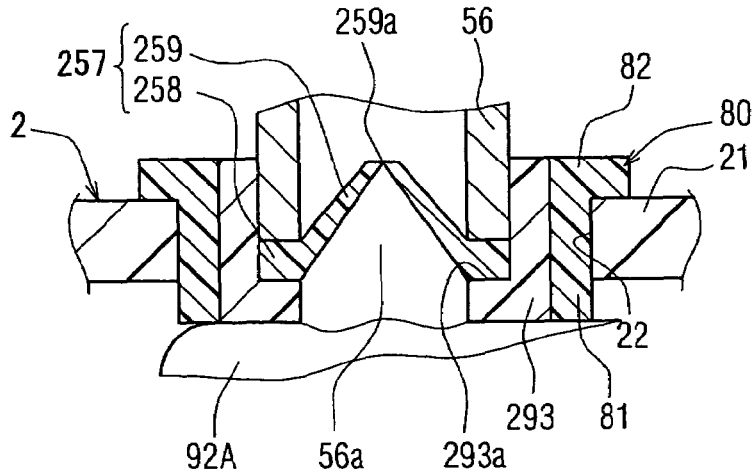
FIG. 22 is a partially sectional view showing a connection between a sub-tank and a suction passage of a fuel pump, according to a seventeenth embodiment.

As shown in FIG. 22, the check valve 257 having a construction of a duckbill valve is arranged between the lower end of the suction pipe 56 and the step 293*a* of the sleeve 293.

Eighteenth Embodiment

Figure 23:
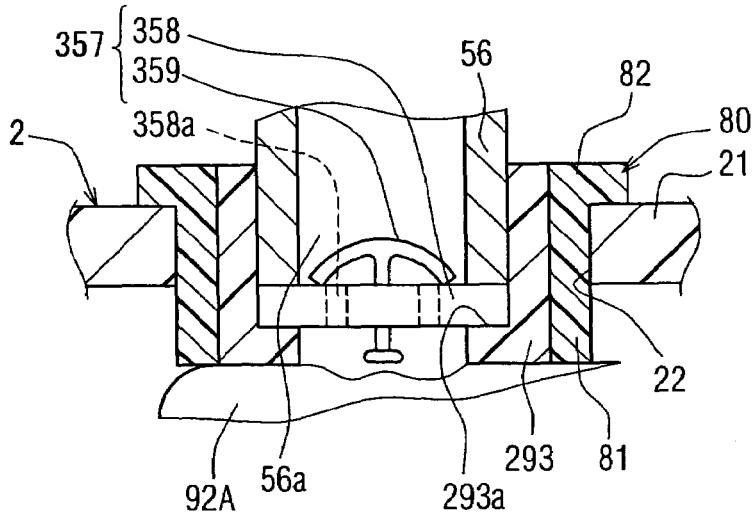
FIG. 23 is a partially sectional view showing a connection between a sub-tank and a suction passage of a fuel pump, according to an eighteenth embodiment.

As shown in FIG. 23, the check valve 357 having a construction of an umbrella valve is arranged between the lower end of the suction pipe 56 and the step 293*a* of the sleeve 293.

Nineteenth Embodiment

Figure 24:
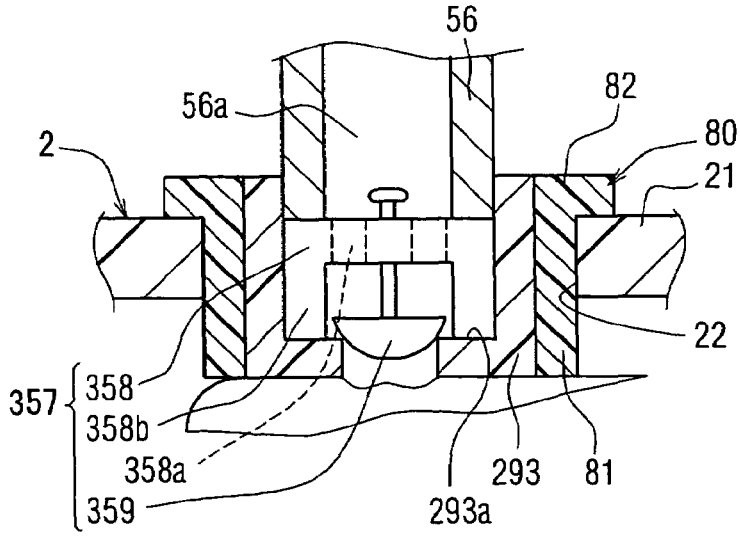
FIG. 24 is a partially sectional view showing a connection between a sub-tank and a suction passage of a fuel pump, according to a nineteenth embodiment.

As shown in FIG. 24, the check valve 357 having a construction of a poppet valve is arranged between the lower end of the suction pipe 56 and the step 293*a* of the sleeve 293. The umbrella portion 359 can be seated on and lifted from the step 293*a* of the sleeve 293. The end of the sleeve 293 serves also as a valve seat. The outer periphery of the cylindrical portion 358 is press fitted into the inner periphery of the sleeve 293. The cylindrical portion 358 may be fitted between the lower end of the suction pipe 56 and the step 293*a* of the sleeve 93. The cylindrical portion 358 may include a no-bridge portion 358*b*.

Twentieth Embodiment

Figure 25:
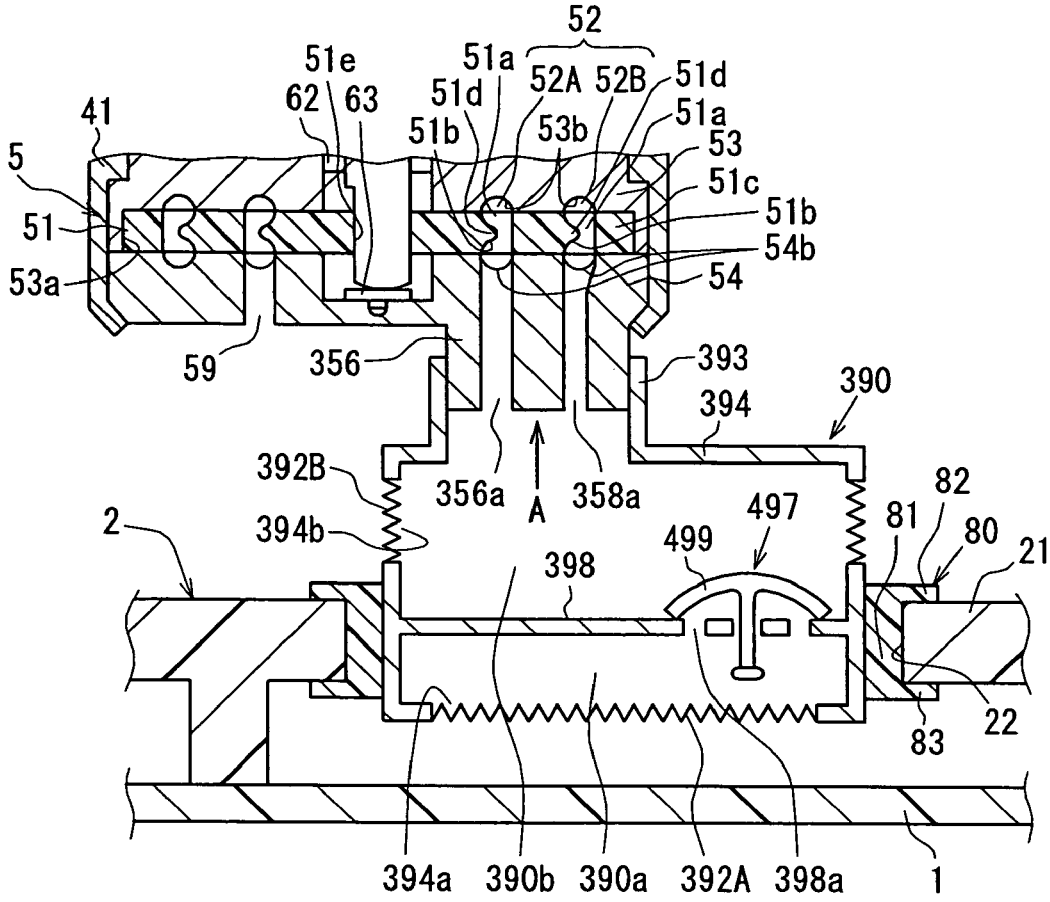
FIG. 25 is a partially sectional view showing a connection between a sub-tank and a two-stage filter of a fuel pump, according to a twentieth embodiment.
Figure 26:
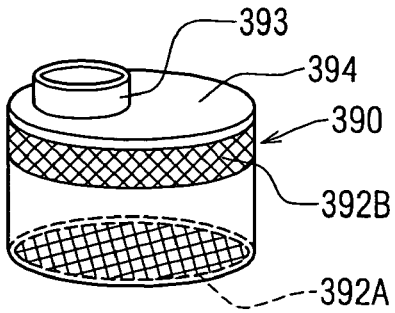
FIG. 26 is a perspective view showing the two-stage filter depicted in FIG. 25.
Figure 27:
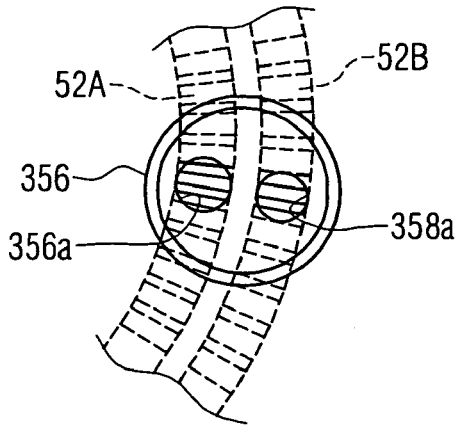
FIG. 27 is a view when being viewed from the arrow A in FIG. 25.

As shown in FIGS. 25, 26, and 27, a two-stage filter 390 is provided instead of the filters 90A, 90B.

In FIG. 25, the two-stage filter 390 includes therein a first suction passage 356*a* corresponding to the suction pipe and a second suction passage 358*a* corresponding to the discharge pipe. In FIG. 27, the first suction passage 356*a* and the second suction passage 358*a* respectively lap the first pump chamber 52A and the second pump chamber 52B of the fuel pump 3. The two-stage filter 390 is inserted into the sub-tank 2. The connection between the two-stage filter 390 and the sub-tank 2 is sealed using an elastic member 80.

The two-stage filter 390 has a common duct 393 and multiple filtering members. In this embodiment, the filtering members include a first filtering member 392A and a second filtering member 392B. The common duct 393 is divided into a first suction passage 356*a* and a second suction passage 358*a* to introduce fuel. The common duct 393 may connect with a suction pipe 356. The first filtering member 392A communicates with the fuel tank 1. The second filtering member 392B communicates with the sub-tank 2.

As referred to FIGS. 25 and 26, a filtering vessel 394 is, for example, a cylindrical vessel formed of resin. The filtering vessel 394 has a first opening 394*a*, a second opening 394*b*. The filtering vessel 394 has a partition 398, which partitions between the first opening 394*a* and the second opening 394*b*. The first filtering member 392A is mounted to the first opening 394*a*. The second filtering member 392B is mounted to the second opening 394*b*.

A check valve 497 is provided to the partition 398. The check valve 497 restricts fuel from causing backflow toward the first filtering member 392A. In FIG. 25, the check valve 497 has a generally known construction of an umbrella valve. The check valve 497 includes an umbrella portion 499. The partition 398 has a flow portion 398*a*. The check valve 497 may have any construction of such as a duckbill valve. The two-stage filter 390 communicates with the first suction passage 356*a* therein. The two-stage filter 390 is inserted into the sub-tank 2. The connection between the two-stage filter 390 and the sub-tank 2 is sealed by the elastic member 80.

The elastic member 80 restricts transmission of vibration to the sub-tank 2, and improves airtightness of the connection with the sub-tank 2. In this structure, the number of components can be reduced compared with a structure in which two filters 90A, 90B are separately provided. The elastic member 80 seals the connection between the cylindrical filtering vessel 394, which includes the two filters 90A, 90B, and the sub-tank 2. In this structure, productivity can be enhanced without an increase in the number of components.

The filtering vessel 394 includes the partition 398. The partition 398 partitions between the first filtering member 392A, which filters fuel flowing from the fuel tank 1, and the second filtering member 392B, which filters fuel flowing from the sub-tank 2. The partition 398 is provided with the check valve 497. The check valve 497 permits fuel filtered through the first filtering member 392A to flow only in the normal flow direction.

Fuel passing through the check valve 497 can be accommodated in the space on the side of the second filtering member 392B in the filtering vessel 394, which is partitioned by the partition 398. Even when the fuel pump 3 stops, fuel can be accommodated on the side of the second filtering member 392B in the sub-tank 2.

The first filtering member 392A and the second filtering member 392B may be different in mesh density from each other. One of the first filtering member 392A and the second filtering member 392B may be coarse in mesh density as long as not to obstruct an operation of the fuel pump 3, so that drive load of the fuel pump 3 can be reduced.

Twenty-First Embodiment

Figure 28:
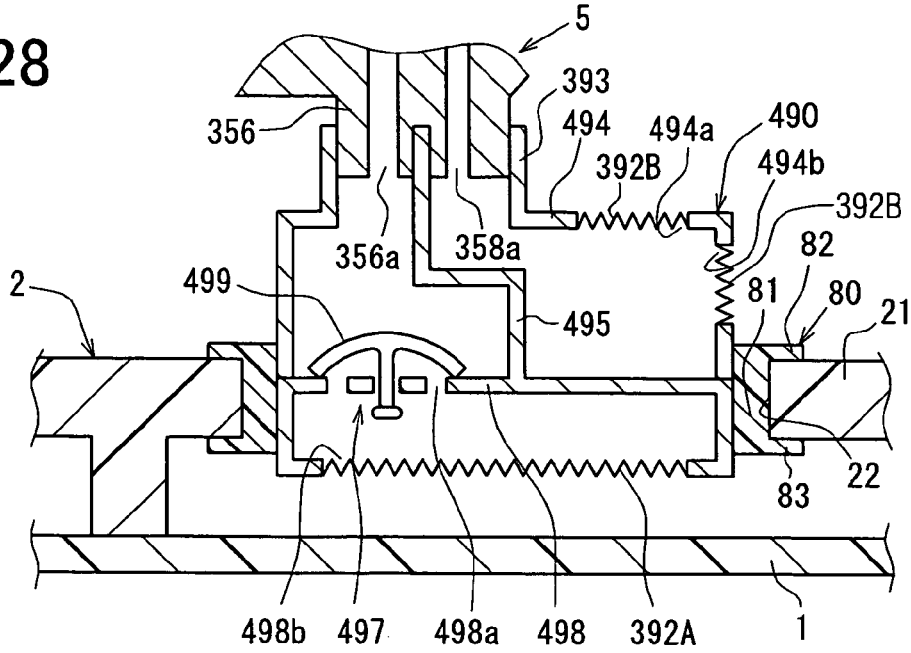
FIG. 28 is a partially sectional view showing a connection between a sub-tank and a two-stage filter of a fuel pump, according to a twenty first embodiment.
Figure 29:
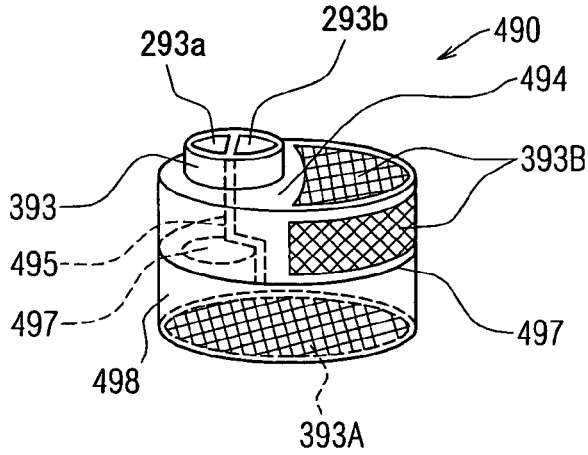
FIG. 29 is a perspective view showing the two-stage filter depicted in FIG. 28.

As shown in FIGS. 28 and 29, a partition 498 has a partition portion 495 in a filtering vessel 494 of a two-stage filter 490. The partition portion 495 extends into the duct 393 to define a partition between the second suction passage 358*a* and the first suction passage 356*a*. The check valve 497 is provided in the vicinity of a pump suction passage, which is partitioned by the partition portion 495. The partition 498 and the partition portion 495 partition the interior of the filtering vessel 494 into the first suction passage 356*a* and the second suction passage 358*a*. The first suction passage 356*a* corresponds to the first filtering member 392A. The second suction passage 358*a* corresponds to second filtering members 392B. The check valve 497 is provided in the first suction passage 356*a*.

Other Embodiments

One component of the single impeller 51 may have pump chambers in multiple rows, such as three rows, four rows, or the like. It suffices that a pump suction passage be provided to permit fuel from outside the sub-tank 2 to be drawn into at least one pump chamber among the multiple pump chambers.

The construction may be variously modified as long as an elastic member such as the elastic member 80 seals the connection between the pump suction passage and the sub-tank.

The elastic member 80 may have any structure as long as the elastic member 80 is formed of a material, such as rubber material, elastomer, resin, etc., which has elasticity.

Figure 30:
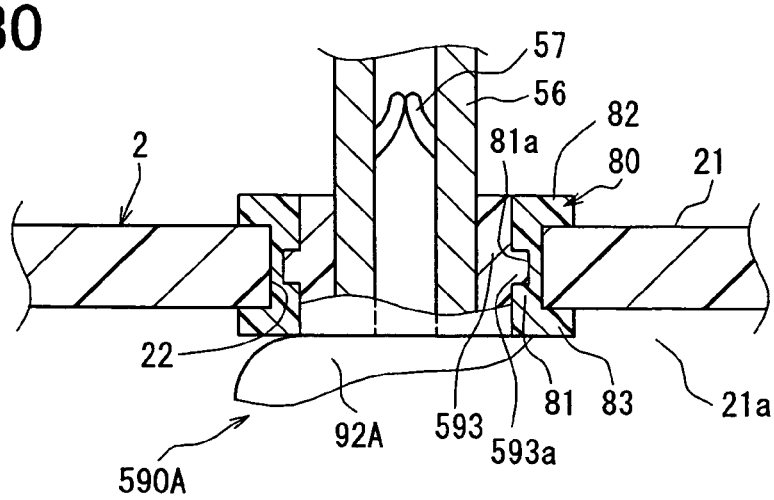
FIG. 30 is a partially sectional view showing a connection between a sub-tank and a suction passage of a fuel pump, according to an other embodiment.

As shown in FIG. 30, a latch portion 593*a* may be provided to the outer periphery of a sleeve 593 of a suction filter to restrict dislocation in the connection relative to the elastic member 80. The latch portion 593*a* may be arranged at the connection between the through-hole 22 of the sub-tank 2 and the sleeve 593.

The motor portion 6 may be a brushless motor.

The number of the pump chambers 52 is not limited two. The number of the pump chambers and the construction of the impeller can be variously modified.

The above structures of the embodiments can be combined as appropriate.

Various modifications and alternations may be diversely made to the above embodiments without departing from the spirit of the present invention.

What is claimed is:

1. A fuel feed apparatus accommodated in a fuel tank, the fuel feed apparatus comprising:

a sub-tank that is provided in a bottom of the fuel tank; and a fuel pump that is accommodated in the sub-tank, wherein the fuel pump includes an impeller that defines a plurality of pump chambers, the fuel pump has a first suction passage through which fuel flows from outside the sub-tank into at least one of the plurality of pump chambers, and the fuel feed apparatus further comprising:

an elastic member that seals between the first suction passage and the sub-tank, wherein the fuel pump further has a second suction passage through which fuel flows from the sub-tank into at least one of the plurality of pump chambers, the fuel feed apparatus further comprising:

a two-stage filter through which fuel flows to the first suction passage and the second suction passage, wherein the two-stage filter is inserted into the sub-tank, and the elastic member seals between the two-stage filter and the sub-tank.

2. The fuel feed apparatus according to claim 1, wherein the plurality of pump chambers includes a first pump chamber and a second pump chamber, the first pump chamber is located radially inside of the second pump chamber, fuel is supplied to the first pump chamber through the first suction passage, and fuel is discharged outside the fuel tank through the second pump chamber.

3. The fuel feed apparatus according to claim 1, wherein the elastic member includes a flange that is joined to the sub-tank.

4. The fuel feed apparatus according to claim 1, wherein the fuel pump includes a suction pipe which defines the first suction passage, the sub-tank has a bottom portion that has a projection to which the suction pipe extends, the elastic member includes a first elastic portion and a second elastic portion, the first elastic portion seals radially between the projection and the suction pipe, and the second elastic portion is interposed axially between the suction pipe and the bottom portion.

5. The fuel feed apparatus according to claim 1, wherein the elastic member has a recess via which the elastic member is fitted to an inner periphery defining the through-hole of the sub-tank, and the elastic member axially connects with both surfaces of the sub-tank via the recess.

6. The fuel feed apparatus according to claim 1, wherein the fuel pump further has a second suction passage through which fuel flows from inside the sub-tank into an other of the plurality of pump chambers.

7. The fuel feed apparatus according to claim 1, further comprising:

a check valve that is provided to the first suction passage for restricting backflow of fuel.

8. The fuel feed apparatus according to claim 7, wherein the check valve is a duckbill valve that is formed integrally with the elastic member.

9. The fuel feed apparatus according to claim 1, wherein the fuel pump includes a suction pipe, which defines the first suction passage, the sub-tank has a through-hole through which the suction pipe extends, and the elastic member seals between the through-hole of the sub-tank and an outer periphery of the suction pipe.

10. The fuel feed apparatus according to claim 9, further comprising:

a duct connecting with the suction pipe; and a suction filter connecting with the duct via the suction pipe for filtering fuel, wherein the elastic member seals an inner periphery of the through-hole of the sub-tank and an outer periphery of one of the suction pipe and the duct.

11. The fuel feed apparatus according to claim 9, further comprising:

a duct that connects with the suction pipe; and a suction filter for filtering fuel, wherein the elastic member seals an inner periphery of the through-hole of the sub-tank and an outer periphery of one of the suction pipe and the duct.

12. The fuel feed apparatus according to claim 11, wherein the outer periphery of the one of the suction pipe and the duct has a latch portion that projects toward the inner periphery of the through-hole of the sub-tank.

13. The fuel feed apparatus according to claim 1, wherein the two-stage filter includes a duct, a filtering vessel, a first filtering member, and a second filtering member, fuel is divided into the first suction passage and the second suction passage through the duct, the filtering vessel accommodates therein the first filtering member and the second filtering member, the first filtering member communicates with the fuel tank, the second filtering member communicates with the sub-tank, and the elastic member seals between the filtering vessel and the sub-tank.

14. The fuel feed apparatus according to claim 13, wherein the first filtering member and the second filtering member are different in mesh density from each other.

15. The fuel feed apparatus according to claim 13, wherein the filtering vessel includes a partition and a check valve, the partition partitions between the first filtering member and the second filtering member, and the check valve is provided to the partition to restrict backflow of fuel, which is filtered through the first filtering member.

16. The fuel feed apparatus according to claim 15, wherein the partition includes a partition portion extending into the duct, the partition portion partitions the first suction passage from the second suction passage, and the check valve is provided to the partition on a side of the first suction passage.

* * * * *